United States Patent [19]

Iseki et al.

[11] Patent Number: 4,529,207

[45] Date of Patent: Jul. 16, 1985

[54] TOY HAVING INTERCHANGEABLE GAME MODULES

[75] Inventors: Takeo Iseki, Tokyo, Japan; Michael W. Nuttall, S. Pasadena, Calif.; Gorden Spring, Long Beach, Calif.; Herbert Weiland, S. Pasadena, Calif.

[73] Assignee: Tomy Kogyo Company, Incorporated, Japan

[21] Appl. No.: 557,825

[22] Filed: Dec. 5, 1983

[30] Foreign Application Priority Data

Jan. 19, 1983 [JP] Japan ..... 58-5620

[51] Int. Cl.[3] ..... A63F 9/02

[52] U.S. Cl. ..... 273/357; 273/1 L; 273/119 R; 273/343; 273/399; 273/405

[58] Field of Search ..... 273/119 R, 121 R, 357, 273/399, 405, 1 L, 343

[56] References Cited

U.S. PATENT DOCUMENTS

| | | | |
|---|---|---|---|
| 3,297,325 | 1/1967 | Lerner et al. | 273/399 |
| 3,517,936 | 6/1970 | Hicks et al. | 273/1 G |
| 4,079,937 | 3/1978 | Kirsch | 273/357 X |
| 4,174,835 | 11/1979 | Breslow et al. | 273/357 |
| 4,243,227 | 1/1981 | Strongin | 273/357 |
| 4,363,483 | 12/1982 | Minami | 273/1 L |
| 4,382,597 | 5/1983 | Minami | 273/1 L |

*Primary Examiner*—Anton O. Oechsle

*Attorney, Agent, or Firm*—K. H. Boswell

[57] ABSTRACT

A toy has a base having an opening therein which is capable of receiving one of a plurality of game modules. The modules are attached to the base by sliding the modules into the opening in the base. The modules each contain a game, with the game of each being different from the others. Each of the modules include at least one or more objects located therein which are moved in playing the particular game associated with the particular module. The base has first and second activation buttons which are connected via linking members to object strikers which are located in the modules. A single player playing against himself, or two players, can compete by controlling their appropriate buttons to activate the strikers under their control to attempt to move the objects within the game modules.

18 Claims, 6 Drawing Figures

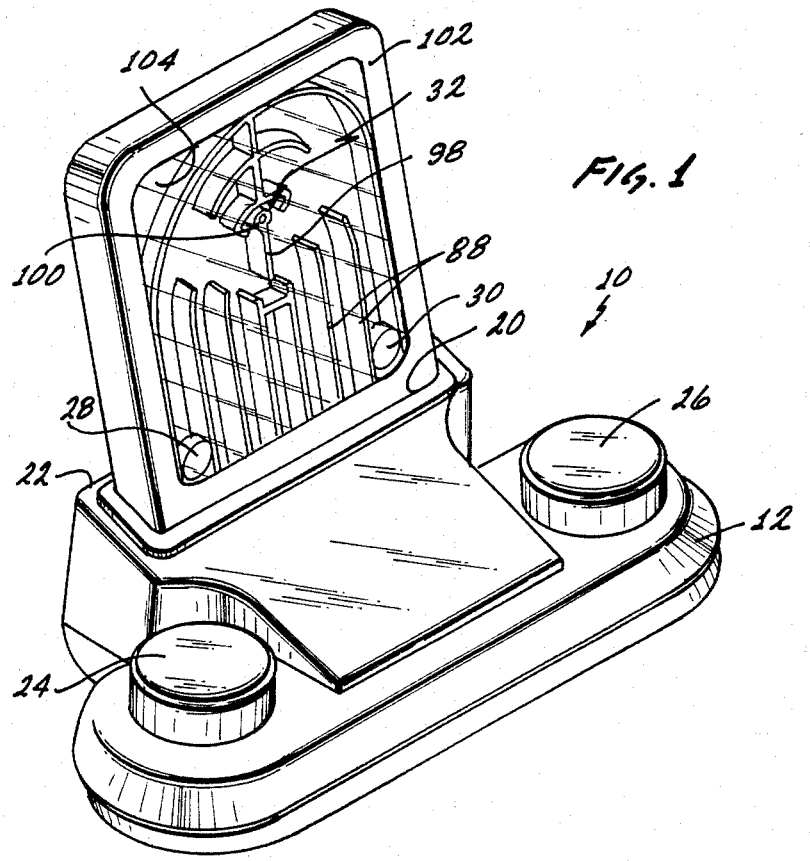
FIG. 1
FIG. 3
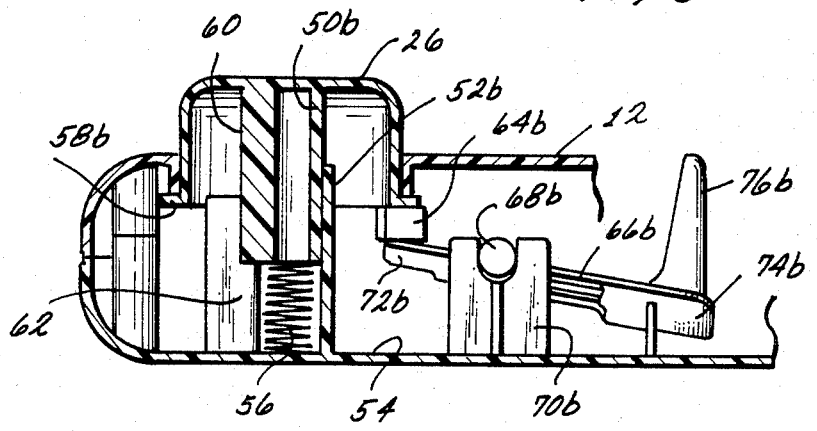

TOY HAVING INTERCHANGEABLE GAME MODULES

BACKGROUND OF THE INVENTION

This invention is directed to a toy which has a base which can accept a plurality of game modules with each of the modules containing a different game. The modules mount on the base one at a time such that the player or players can play the particular game associated with the particular module by manipulating activation buttons on the base so as to move objects located within the playing modules.

A variety of games are known wherein two players compete against one another. In so competing, objects on a game board or the like are propelled from one position by the other via mechanical linkages, magnetic linkages, fluid propulsion (principally air) or by impulse using plungers, striking members and the like. A large number of these games incorporate a sports theme such as football, hockey, or basketball as the central theme of the game, and the players of the game complete against one another. Other of these games incorporate other basis which allow a competitive interaction between the players of the game; however, no matter what the central theme of the game is, these games are only known to incorporate a single theme, and thus play of the game is limited to only that theme.

Recently, with the advent of microprocessor technology, electronic games have become available wherein players can compete with one another. These games range from hand holdable, portable games, to those which are adapted to be connected to home television sets and the like. As with the above noted mechanical games, the hand holdable games are limited to one single theme and thus their play value can deteriorate with continued play because of boredom of the players with the theme of the game.

The electronic game housing which are connectable to home TV sets and the like are capable of accepting a variety of game cartridges, allowing the player to change the game when their interest wanes in the game currently being played. Unfortunately, the TV set and the basic game housing itself, as well as the cartridges, are relatively expensive, and are of such a sophistication that their use is not geared to either pre-school or lower primary grade children.

BRIEF DESCRIPTION OF THE INVENTION

In view of the above, it is a broad object of this invention to provide a toy which utilizes a game module in association with a base. It is a further object of this invention to provide game modules interchangably attachable such that a variety of games can be played utilizing a single base by interchanging the game modules on the base. It is a further object of this invention to provide a toy which, because of its ability to utilize a variety of game modules, offers extended play value for smaller children. It is a further object to provide a toy which, because of its design and engineering principles, is capable of economical manufacture and thus is economically available to the consuming public, yet still employing those engineering principles which result in a long and useful service life.

These and other objects, as will become evident from the remainder of this specification, are achieved in a base; at least one game module; connecting means located on said base for temporarily operatively connecting said module to said base; at least one object movably located on said module; at least one moving means for moving said object on said module when said module is connected to said base, said moving means having a first portion movably mounted on said base and capable of moving on said base in response to being acted upon by an operator of said toy, said moving means having a second portion movably associated with said module and further operatively associated with said first portion so as to be moved with respect to said module in response to movement of said first portion, said second portion in response to movement with respect to said module contacting said object so as to propel said object on said module.

Further, the objects of this invention are achieved in a toy which has a base with an opening or receptacle located on the base so as to accept one of a plurality of game modules, each incorporating a different game therein. Further, the toy will include a moving means, at least a portion of which is associated with the base and at least a further portion of which is associated with any module so located in the receptacle on the base. The modules would each include at least one object or movable member with the moving means, upon being acted upon by an operator of the toy, being capable of interacting with the object of movable member so as to move the object or member on the module.

Further, the objects of this invention are achieved in a toy which includes a base used in association with one of a plurality of game modules differing from one another, each of which includes at least one object or movable member movably mounted thereon. The base will include a module connecting means for temporarily connecting each of said modules, one at a time, to the base. An moving means will be associated with both the base and a module other than that module is connected to the base. The moving means is capable of being acted upon by an operator of the toy, and when so acted upon by an operator of the toy, of moving the object or movable member on the module.

In the preferred embodiment of the invention, two object means would be incorporated within each module so as to allow competitive play between two operators of the toy. Further preferredly, the moving means would include one or more members movably mounted on the base so as to be acted upon by the operator or operators of the toy, and when so acted upon, movable with respect to the base and further movable with respect to the module located on the base so as to be able to contact one or more objects in the module located on the base to move said one or more objects with respect to the module.

Preferredly, each of the modules would include an enclosed housing, having a transparent face allowing viewing into the interior of the housing, with one or more objects located within the interior of the housing. A target means can be located within the interior of the housing and further, baffle means can also be located within the interior of the housing. The target means, of course, would serve as a target for the object, with the baffle means dividing the interior of the housing into compartments, allowing for positioning of the object or objects within the interior of the housing within the compartments.

BRIEF DESCRIPTION OF THE DRAWINGS

This invention will be better understood when taken in conjunction with the drawings wherein:

FIG. 1 is an isometric view showing an embodiment of the invention;

FIG. 3 is a fragmentary, side elevational view in section of a portion of the invention illustrated in FIG. 1;

Figure 2:
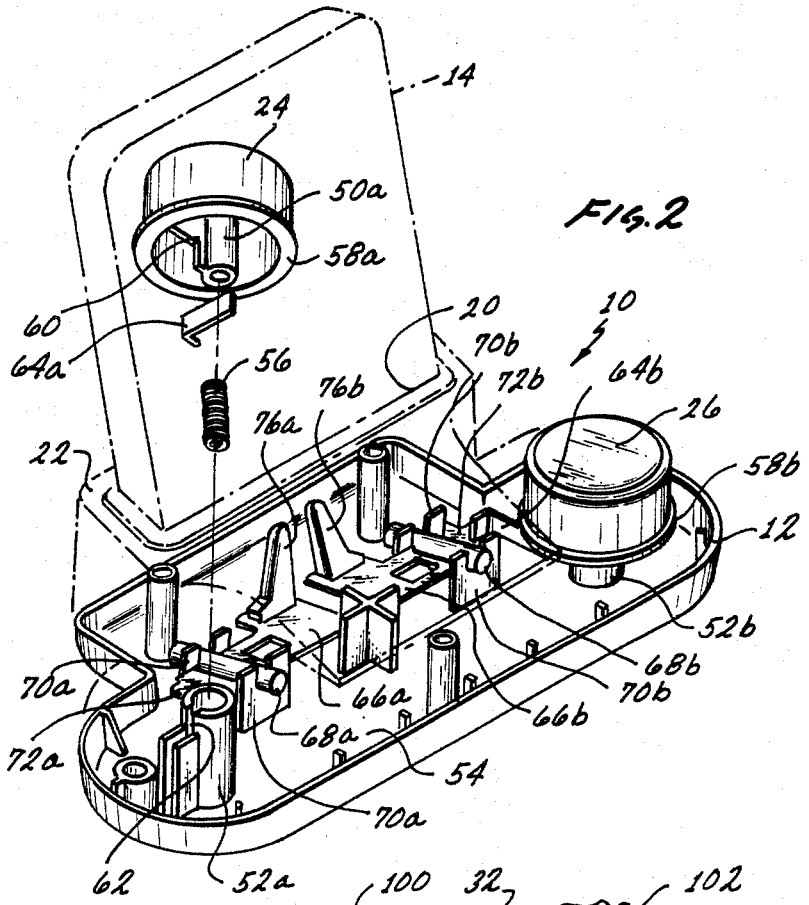
FIG. 2 is an isometric view similar to FIG. 1 except that certain components seen in solid lines in FIG. 1 are shown in phantom line in FIG. 2 and certain overlying components seen in FIG. 1 have been removed for clarity of underlying components, and other components have been exploded to show operation thereof.

The invention illustrated in the drawings and described in this specification utilizes certain principles and/or concepts as are set forth in the claims appended to this specification. Those skilled in the toy arts to which this invention pertains will realize that these principles and/or concepts are capable of being utilized with a variety of embodiments which differ from the embodiment utilized for illustrative purposes herein. For this reason, this invention is not to be construed as being limited only to the illustrative embodiment, but is only to be construed as being limited to the claims.

DETAILED DESCRIPTION OF THE INVENTION

Figure 5:
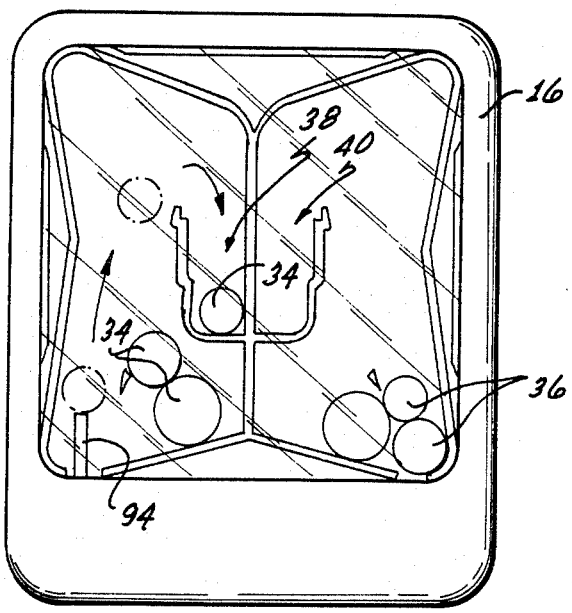
FIG. 5 and FIG. 6 show alternate modular components which can be utilized in replacement for the modular component seen in the upper portion of FIG. 1 and in phantom line in FIG. 2.
Figure 6:
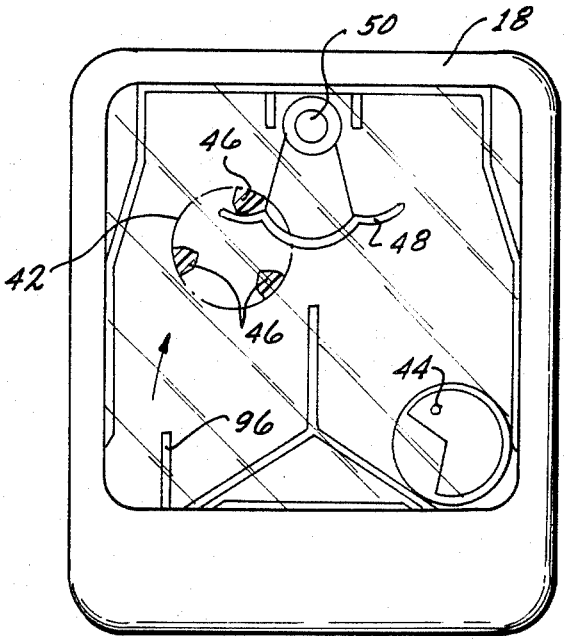

Referring to FIG. 1, a toy 10 of the invention is shown therein. The toy 10 of the invention has two basic components, the base 12 and a game module 14. A plurality of game modules similar to game module 14 can be utilized with respect to the base 12. Two other of these game modules, game modules 16 and 18 are shown in FIGS. 5 and 6 respectively.

The game modules 14, 16 and 18 can be each appropriately attached to the base 12 by simply insertion of the same into an opening 20 formed in top surface 22 of the base 12.

Also projecting out of the top surface 22 of the base 12 are left and right activation buttons 24 and 26, respectively. To play with the toy 10, two opposing players, or a single player controlling both buttons 24 and 26, depress the buttons 24 and 26 in order to move objects, hereinafter individually identified with respect to the particular game modules 14, 16 or 18, to move the objects within the respective game modules 14, 16 or 18.

For the game module 14, two objects 28 and 30 are located within the game module. The button 24 controls movement of the object 28, whereas the button 26 controls movement of the object 30. In playing with the module 14, the player controlling button 24 competes with the player controlling button 26 in attempting to move his particular object, whether it be object 28 or 30, to a target space 32 formed in the center of the game module 14.

In a likewise manner, in playing the game module 16 shown in FIG. 5, the operators of the individual left and right activation buttons 24 and 26 attempt to move objects collectively identified by the numeral 34 under the control of the left activation button 24, and objects collectively identified by the numeral 36 under control of the right activation button 26, upwardly such they fit into target receptacles 38 and 40. In playing with the module 16 seen n FIG. 6, the player controlling the left activation button 24 moves object 42 and the player controlling the right activation button 26 moves object 44. Each of the objects 42 and 44 have a plurality of projections collectively identified by the numeral 46 on their back side, with it being an object of the game to attempt to hang one of the objects 42 or 44 from the target member 48 by catching the projections 46 onto the target member 48. It can be seen that the target member 48 is pivotally mounted about boss 50 such that when one of the objects, such as object 42 seen in the left hand side of FIG. 6 is located on the target member 48, the target member 48 will pivot, lifting its other side upwardly, making it impossible to hang a second of the objects, such as object 44, on the other side of the target member 48 such that there is no question as to which player is the winner of the contest.

Referring now back to FIGS. 1 through 4, and module 14 shown therein, interaction of the base 12 with the module 14 will be described. The modules 16 and 18 will include members equivalent to certain of the members described for module 14 and these members will interact with the components of the base 12 in the same manner and as such will not be individually discussed in detail.

Each of the left and right activation buttons 24 and 26 include a central hollow boss, respectively identified by the numerals 50*a* and 50*b*, which fits into an appropriately slightly larger boss, respectively identified by the numeral 52*a* and 52*b*, which are formed on the bottom surface 54 of the base 12. A spring 56 fits within each boss 52 and pushes upwardly against the bosses 50 so as to urge the respective button 24 or 26 upwardly. The top surface 22 of the base 12 has appropriate openings in its left and right sides allowing for exposure of the top of the activation button 24 and 26 through it. Each of the buttons 24 and 26 includes a flange 58*a* or 58*b* which prevents the spring 56 from pushing the buttons 24 and 26 completely upwardly and out of the top surface 22. The flanges 58 are of a size greater than the openings in the top surface 22 so as to maintain the buttons 24 and 26 from being pushed totally out of the openings in the top surface 22, but allowing buttons 24 and 26 to proceed downwardly toward the bottom surface 54.

The bosses 50 are each keyed with a key 60 which slides in a slot 62 in each boss 52. This prevents the buttons 24 and 26 from rotating within the openings in the top surface 22. Members 64*a* and 64*b* respectively extend outwardly from the buttons 24 and 26 and move upwardly and downwardly with respect to upward and downward movement of the buttons 24 and 26.

Linking members 66*a* and 66*b* formed as first class levers are pivotally mounted about axis 68*a* and 68*b* formed thereon which fit into upstanding ears, collectively identified by the numeral 70, which project upwardly from the bottom surface 54 of the base 12. The members 66*a* and 66*b* thus can teeter back and forth on their axles 68. The members 64*a* and 64*b* fit over ends 72*a* and 72*b* of the linking members 66*a* and 66*b* respectively, such that downward motion of either of the buttons 24 or 26 is transferred to the respective linking members 66*a* and 66*b* causing them to rotate about their respective axles 68.

In FIG. 3, the linking member 66*a* for the button 24 is shown in a first orientation with the spring 56 biasing the button 26 fully upwardly within its opening in the top surface 22. In moving to FIG. 4, the other button, button 26 is shown in a second orientation having been depressed downwardly by an operator of the game, compressing its spring 56 and in turn causing its member 64*b* to contact the end 72*b* of the linking member 66*b* to rotate the linking member 66*b* about its axle 68*b*. This raises the end 74*b* of the linking member 66*b* upwardly and in so doing also raises extension 76*b* of linking member 66*b* upwardly. When the pressure on the button 26 is released, spring 56 of course pushes the button 26 upwardly, and since the mass of the linking member 66*b* as seen in FIG. 4 is on the left hand side of axle 68*b*, the linking member 66*b* rotates under the influence of gravity from the position seen in FIG. 4 to a position equivalent to that seen in FIG. 3 for button 24.

As can be seen in FIG. 2, there is a left hand and right hand symmetry of the components located within the base 12 with the left hand components identified by the appropriate numeral followed by the alphabetical letter "a" and the right hand components located by the same numeral followed by the alphabetical letter "b". The two sets of components are identical in function with the only difference being the mirror imagery between the linking members 66*a* and 66*b*.

Figure 4:
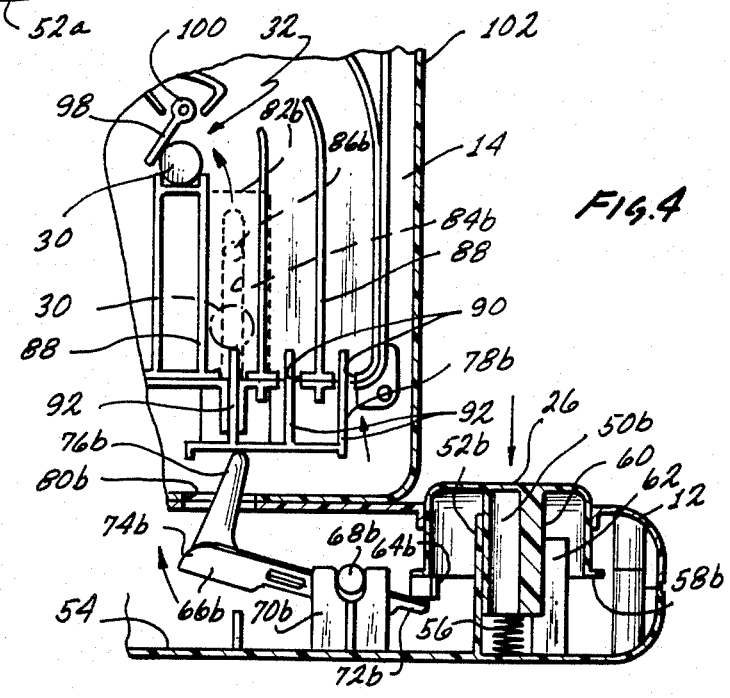
FIG. 4 is a fragmentary front elevational view in section of the right hand portion of the invention as seen in FIG. 1.

Each of the modules 14, 16 or 18, all include striking members, as is illustrated for module 14 in FIG. 4. There is a symmetry within the modules 14, 16 and 18, such that both a left and right hand striking member is present. Additionally, directly below each of the striking members is an opening, as is also evident for the right hand side of module 14 shown in FIG. 4. When one or the other of the buttons 24 or 26 are depressed, its appropriate linking member, be it linking member 66*a* or 66*b*, is rotated about its axles such that the appropriate extension 76*a* or *b* lifts upwardly and moves into the bottom of the particular module currently attached to the base 12 by passing through the openings in the bottom of the module. This allows the extension 76*a* or *b* on the appropriate linking member 66*a* or *b* to pass through the appropriate opening in the module and contact the respective striking member with which it is associated. Thus, as with the base 12, there is symmetry within each of the modules 14, 16 and 18 with regard to striking members and openings. This is illustrated with reference to module 14 in FIG. 4.

In FIG. 4, striker member 78*b* is seen located within the right hand side of module 14. Below the striker 78*b* is opening 80*b* which allows for passage of the extension 76*b* into the bottom of the right hand side of module 14. When the extension 76*b* is raised upon depression of the button 26, it strikes the striker member 78*b*, lifting the striker member 78*b* upwardly against the bias of gravity.

As can be seen in phantom line in FIG. 4, extending upwardly from the striker 78*b* is a vertical extension 82. The vertical extension 82 is formed as a part of striker 78*b* and includes a slot 84 formed therein. The slot 84 fits over a boss 86 which is formed in the back surface of the module 14 and projects forward such that the slot 84 can fit over it.

In module 14 there is a series of baffles collectively identified by the numeral 88. Inbetween each of the baffles 88 is a bottom opening, collectively identified by the numeral 90. The striker member 78*b* includes three arms, collectively identified by the numeral 92. The arms 92 of the striker member 78*b* fit within the openings 90, and this, in combination with the fit of the slot 84 over the boss 88 assures that the striker member 78*b* moves upwardly and downwardly along a straight path. Spaces are formed between the baffles 88 which from compartments for the objects, such as the object 30 seen in FIG. 4. The object 30 in FIG. 4 would be in the left handmost compartment of the right hand side of the module 14. The striker member 78*b*, in moving upwardly and downwardly in the module 14 under the influence of the extension 76*b*, moves such that its arms 92 move upwardly within these compartments and can contact any object, such as the object 30, which might be located in the compartments, and in so contacting the object 30, imparting a momentum to the object 30 such that the object 30 is lifted upwardly out of the compartment and can be directed toward the target 32.

As was noted before, there exists symmetry within the module 14 such that there would be a corresponding left side striker member with baffles and the like as per the right side striker member 78*b*. Additionally, in the modules 16 and 18, there would be striker members of similar construction with an arm 94 of the striker member on the left hand side of module 16 seen in FIG. 5, and an arm 96 of the left hand striker member of the module 18 seen in FIG. 6. It can be seen in these Figs. that the two striker members 94 and 96 in their respective modules 16 and 18 have contacted objects on the left hand side of these particular modules, objects 34 and 42, and have propelled them upwardly. Additionally, it can be seen that there are baffles, not separately identified or numbered, in the modules 16 and 18 which serve to direct the movement of the objects located therein.

For the module 14, there is a small arm 98 which is pivotally mounted about a boss 100 directly over the target area 32. When one of the players utilizing the toy 10 wit the module 14 attached thereto successfully launches his object, be it object 28 or 30, and locates the object in the target area 32, the object strikes the arm 98 and rotates it such that the opposite object is not capable of being located in the target area 32 and thus the players know who was the winner of the game.

Each of the modules 14, 16 and 18 have an outside housing member 102, as is illustrated for module 14 in FIG. 1, which has a transparent face 104 located thereon. Together the housing member 102 and the face 104 form an enclosure which has a hollow interior which serves to keep the respective objects 28, 30, 34, 36,42 or 44 located within their respective modules 14, 16 or 18.

We claim:

1. A toy which comprises:

a base;

a plurality of game modules differing from one another, each of said modules temporarily connectable one at a time to said base, each of said modules including at least one object movebly located on the respective modules;

connecting means located on said base for temporarily operatively connecting one of said modules to said base; at least one moving means for moving said object on said module when said module is connected to said base, said moving means having a first portion movably mounted on said base and capable of moving on said base in response to being acted upon by an operator of said toy, said moving means having a second portion movably associated with said module and further operatively associated with said first portion so as to be moved with respect to said module in response to movement of said first portion, said second portion in response to movement with respect to said module contacting said object so as to propel said object on said module.

2. The toy of claim 1 including:

a first and a second moving means, each of said moving means having a first portion and a second portion, each of said first portions movably mounted on said base and capable of independently moving on said base in response to being independently acted upon by an operator of said toy, each of said second portions movably associated with a module when said module is connected to said base and further one of said second portions movably associated with one of said first portions and the other of said second portion movably associated with the other of said first portions, both of said second portions moving with respect to said connecting module in response to movement of the respective first portion with which they are associated, upon moving each of said second portions capable of independently contacting an object in said connected module to propel said object on said module.

3. The toy of claim 1 wherein:

said first portion of said moving means includes an operator interface member movably mounted on said base and capable of being acted upon by said operator and when so acted upon moving on said base;

said second portion of said moving means includes an object striking member, said object striking member operatively associated with said interface member so as to be moved by said interface member, said object striking member for striking an object located on a module connected to said base upon movement of said striking member to propel said object on said module.

4. The toy of claim 3 wherein:

said moving means further includes a linking member, said linking member movably mounted on said base and operatively connected to both said interface member and said striking member, said linking member transferring movement of said interface member to said striking member.

5. The toy of claim 4 wherein:

each of said modules includes an object striking member movably located within said interior of said module;

each of said module further includes access means connecting said interior of the housing of said module to said base when said module is operatively connected to said base, a porton of said linking member associated with said access means when said module is connected to said base so as to operatively connect said linking member to said striking member.

6. The toy of claim 1 wherein:

each of said game modules includes a housing having an enclosed interior, said housing having a transparent face so as to permit viewing of the interior of said housing through said face, any of said objects of each of said modules contained in and movable within the housing of the respective module.

7. The toy of claim 6 wherein:

each of said modules includes a target means located within the interior of the housing of each of said modules and viewable through the face of the respective module, said target means forming targets for said objects.

8. The toy of claim 6 wherein said modules each including a target means located within said interior of said housing and viewable through said face, said target means forming a target for said object.

9. The toy of claim 8 wherein:

at least one of said modules including baffle means located within said interior of said housing, said baffle means forming compartments within said housing, said object positionable within said compartments.

10. A toy game of skill which comprises:

a base, said base including an opening, said opening sized to receive a portion of a game module;

a plurality of game modules differing from one another, each of said plurality of game modules including at least one movable member movably located thereon, each of said plurality of game modules temporarily connectable one at a time to said base by fitting within said opening;

each of said game modules including at least one movable member movably mounted on said game module;

said base further including a first and second moving means each of which includes a portion thereof which is located on said base so as to be acted upon by an operator of said toy, each of said moving means further operatively associated with one of said module when said module fits within said opening, each of said first and said second moving means independently capable of moving upon being acted on by said operator, and upon moving each of said first and said second moving means capable of interacting with said movable member to move said movable member on said module.

11. The toy of claim 10 wherein:

said portion of each of said moving means which is positioned on said base comprising a first portion, said first portion movably mounted on said base and capable of moving with respect to said base in response to being acted on by said operator;

each of said moving means further includes second portion, said second portion of each of said moving means movably mounted on said module and operatively associated with said first portion of its respective moving means, said second portion is moved on said module in response to movement of said first portion of its respective moving means.

12. The toy of claim 11 wherein:

said second portion of each of said moving means comprises a striker member slidably movable on said module and capable of moving said movable member on said module by contacting said movable member as said striker member slidably moves on said module.

13. A toy which comprises:

a base;

a plurality of game modules differing from one another, each of said modules including at least one movable member movably mounted on said module;

said base including module connecting means for temporarily connecting each of said modules one at a time to said base;

at least one moving means associated with said base and further operatively associated with a module when said module is temporarily connected to said base, said moving means capable of being acted upon by an operator of said toy and when so acted on said moving means moving with respect to said base and said module and in so moving said moving means interacting with said movable member so as to move said movable member upon said module.

14. The toy of claim 13 including:

a first portion of said moving means associated with said base and a further portion of said moving means associated with a module when said module is so temporarily connected to said base.

15. The toy of claim 18 wherein:

said first portion of said moving means includes an operator interface means and a linking means, said operator interacting with said operator interface means to move said operator interface means, said linking means movably associated with said operator interface means and movable in response to movement of said operator interface means.

16. The toy of claim 15 wherein:

said second portion of said moving means includes each of said modules having a striker means, said striker means operatively associated with said linking means when said module wherein said striker means is located is connected to said base.

17. The toy of claim 16 wherein:

said connecting means comprises said base having an opening sized and shaped so as to contain a portion of one of said modules, said module mounting to said base by having a portion thereof fitting into said opening.

18. The toy of claim 13 wherein:

each of said game modules includes a housing having an enclosed interior, said housing having a transparent face so as to permit viewing of the interior of said housing through said face, any of said objects of each of said modules contained in and movable within the housing of the respective module.

* * * * *

UNITED STATES PATENT AND TRADEMARK OFFICE

CERTIFICATE OF CORRECTION

PATENT NO. : 4,529,207

DATED : July 16, 1985

INVENTOR(S) : ISEKI et al

It is certified that error appears in the above-identified patent and that said Letters Patent is hereby corrected as shown below:

Column 1, line 22, "complete" should read --compete--.

Column 2, line 28, "of" should read --or--.

Column 2, line 37 "An" should read --A--.

Column 3, line 45 "simply" should be --simple--.

Column 4,line 5 "n" should be --in--.

Column 4, line 52 "axis" should be --axles--.

Column 5, Line 1 "66a" should be --66b--; and further "24" should be --26--.

Column 5, line 4 delete the words "the other button".

Column 5, line 10 "24" should be --26--.

Column 5, line 5 "from" should be --form--.

Column 6, line 38 "wit" should be--with--.

Column 6, line 58 "movebly" should be --movably--.

Column 9, line 18 "12" should be --14--.

Signed and Sealed this

Twenty-first Day of January 1986

[SEAL]

Attest:

DONALD J. QUIGG

Attesting Officer

Commissioner of Patents and Trademarks